United States Patent [19]

Wilkinson et al.

[11] 4,245,631

[45] Jan. 20, 1981

[54] FRIGID AIR RESPIRATOR

[76] Inventors: Richard A. Wilkinson, 1316 Jersey Ave.; Thomas M. Brown, R.R. 6, Box 191, Isaogle Rd., both of Muncie, Ind. 47302

[21] Appl. No.: 44,584

[22] Filed: Jun. 1, 1979

[51] Int. Cl.[3] ..... A62B 7/00

[52] U.S. Cl. ..... 128/204.17; 128/207.12; 128/203.27

[58] Field of Search ..... 128/203.27, 203.26, 128/204.17, 201.13

[56] References Cited

U.S. PATENT DOCUMENTS

| | | | |
|---|---|---|---|
| 3,045,670 | 7/1962 | Hirtz et al. | 128/203.27 |
| 3,107,669 | 10/1963 | Gross | 128/204.17 |

FOREIGN PATENT DOCUMENTS

| | | | |
|---|---|---|---|
| 1026189 | 4/1953 | France | 128/204.17 |
| 197946 | 4/1924 | United Kingdom | 128/204.17 |

*Primary Examiner*—Henry J. Recla

*Attorney, Agent, or Firm*—Cross, Marshall, Schuck & DeWeese

[57] ABSTRACT

A frigid air respirator comprising a cylindrical housing affixed to a face mask, openly constructed so as to permit the passage of air upon inhalation by the user into the chamber formed by the housing. A heating means is situated within the housing to increase the temperature of incoming air by radiation and a transversely positioned intake valve governs the admission of air into the respiratory tract of the user and divides the chamber formed by the housing into an internal chamber which is contiguous with the mask cavity and into a receiving chamber wherein a supply of previously heated air is stored prior to inhalation. An exhaust valve is encompassed into the device to allow the expulsion of air from the internal chamber and mask cavity.

2 Claims, 4 Drawing Figures

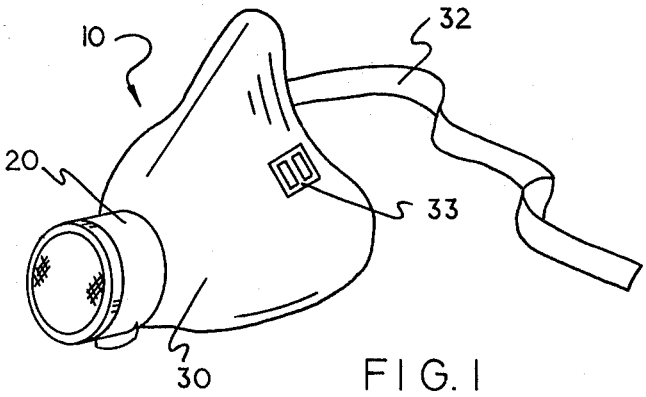
FIG. 1
FIG. 2
FIG. 3
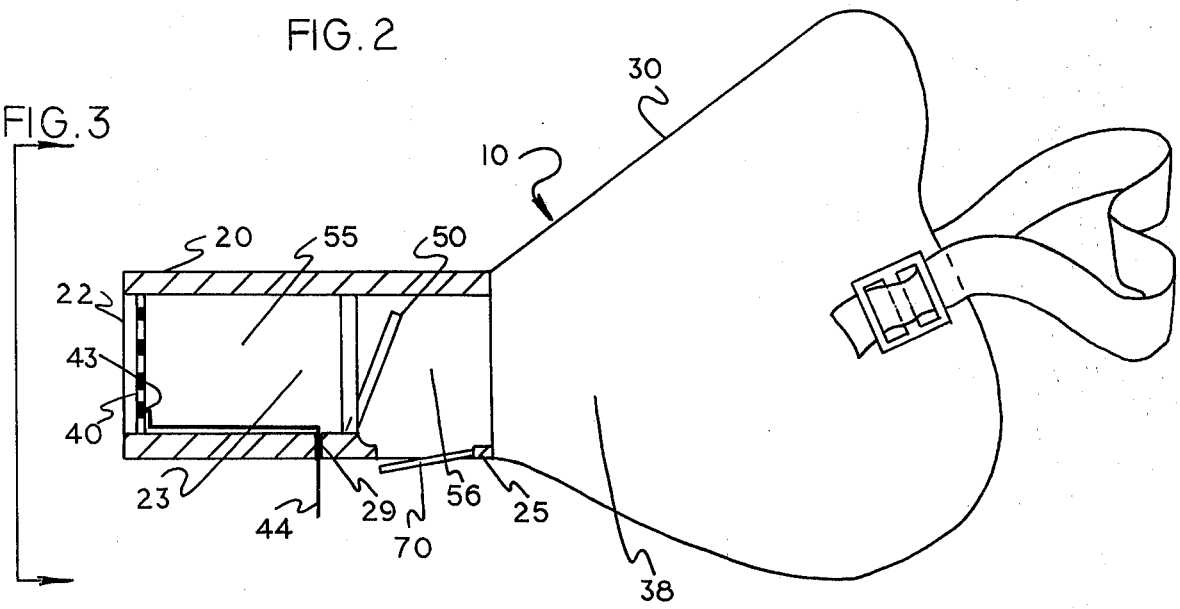
FIG. 3
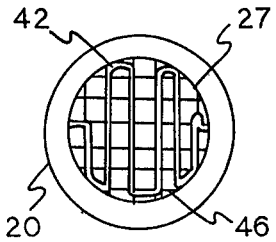

FRIGID AIR RESPIRATOR

BACKGROUND OF THE INVENTION

The present invention relates to a mask apparatus assisting in the respiratory process, and in particular to an apparatus enabling persons with physiological deficiencies such as cardiac or respiratory ailments to be active in frigid air environments without subjecting their respiratory systems to the stress created by inhaling extremely cold ambient air.

It is well known that the inhalation of air in low temperature surroundings may be burdensome on the human respiratory system, sharply reducing the ability to carry on outside activities efficiently under such conditions. In order to adequately admit oxygen into the body, the frigid ambient air from which it is taken must be warmed sufficiently in the upper respiratory tract. Such a process necessitates a dissipation of a great deal of heat energy, and may result in the initiation of fatigue far more rapidly than in warmer climates. Persons with cardiac problems or respiratory deficiencies are especially susceptible to discomfort and impaired function caused by the inhalation of cold air and may even be subject to intense pain or attacks of angina pectoris as a result. Due to their increased sensitivity to the breathing of frigid air, such persons have often been forced to sharply reduce work and other activities outdoors or forego them altogether.

In recognition of the need for a means of enabling persons with cardiac or respiratory impediments to withstand substantial periods of exposure to air in frigid environments without these difficulties, a number of devices have been developed in the prior art for the purpose of reducing the harmful or dangerous effects caused by the inhalation of extremely cold air. While some of these devices operate to increase air temperature to some degree, they all possess deficiencies rendering them less effective and their use less desirable than that of the present invention.

For example, U.S. Pat. No. 3,491,754 to Weese, U.S. Pat. No. 3,707,966 to Nebel, and U.S. Pat. No. 4,062,359 to Geaghan all disclose devices wherein the body temperature of the user is employed in some fashion to heat ambient air before it is inhaled. Inlet tubes or pads are placed underneath the wearer's clothing, and as the person inhales, heated air in close proximity to the body is transported through conduit means of some sort to the person's nose and mouth. Devices utilizing the body heat in this manner have the obvious disadvantage of being able to introduce only stale air into the respiratory system of the user. In addition to the somewhat undesirable quality of the preheated air, apparatuses such as those are cumbersome and impede the normal functioning of the user. Furthermore, if the user is performing even moderately strenuous tasks, his or her oxygen requirements are substantially increased and it is doubtful that these devices are capable of providing enough sufficiently warmed air to satisfy such demand.

The principle of applying heat energy from a person's exhalations to increase temperature of incoming air is taught by U.S. Pat. No. 3,333,585 to Barghini and U.S. Pat. No. 3,814,094 to DeAngelis. Valveless mask apparatuses fit over the user's nose and mouth. As the user exhales, some of the heat energy from his expelled breath is absorbed by materials in the mask. Air to be inhaled is drawn through the mask and is warmed by the resultant transfer of heat energy. These devices suffer from the obvious disadvantage of intermingling exhaled air with inhaled air. An excess buildup of carbon dioxide within the cavity between the mask and the user's face is possible in situations where the user is required to breathe rapidly, rendering its use as a breathwarmer difficult if not impossible. Additionally, the ability of such devices to adequately warm enough quantities of air to satisfy the user's demands in extremely frigid conditions or in situations where the user is forced to breathe rapidly or heavily is highly doubtful.

U.S. Pat. No. 3,249,108 to Terman features a heating element contained in a pocket of a mask with incoming air passing through the element becoming heated by radiation. In situations in which the user is required to breathe heavily or rapidly, this device too may be inadequate to provide the needed quantities of sufficiently heated air, and there is also the potential for buildup of excess carbon dioxide that is present in other devices.

SUMMARY OF THE INVENTION

The present invention was developed in an effort to circumvent the disadvantages existing in the devices of the prior art.

Accordingly, it is an object of the invention to provide an improved frigid air respirator for use by persons exposed to cold air environments.

Another object is to provide a frigid air respirator as aforesaid which is capable of efficiently supplying adequate quantities of heated air despite rapid or heavy breathing by the user.

Another object is to provide a frigid air respirator as aforesaid which supplies fresh air to the user.

Other objects and features of the invention are to be found in the following description and claims.

DESCRIPTION OF THE DRAWINGS

Drawings accompany the disclosure and the various views thereof may be briefly described as:

FIG. 1, a pictorial view of the device;

FIG. 2, a side view of the device wherein the cylindrical housing is shown in section;

FIG. 3, a frontal view of one embodiment of the heating means to be incorporated into the device, taken along the line indicated in FIG. 2;

DESCRIPTION OF THE PREFERRED EMBODIMENT

Figure 4:
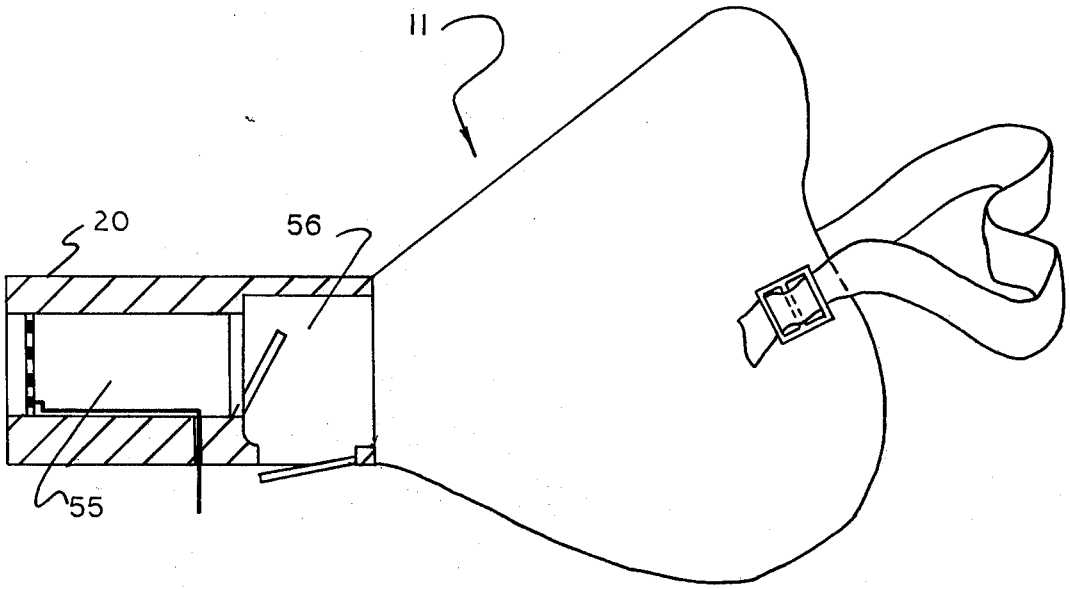
FIG. 4, a side view of another embodiment of the device, wherein the cylindrical housing is shown in section.

Referring now to FIG. 1, there is pictorially shown a frigid air respirator generally indicated by the number 10. A cylindrical housing 20 extends outwardly from a face mask 30 to which it is affixed. The device can be secured to the head of the user in any conventional fashion, such as by the use of a strap 32 and buckle 33 as depicted.

As disclosed in FIG. 2, the end 22 of the housing 20 which is not attached to the face mask 30 is open and permits the entry of air into the cylindrical chamber 23 defined by the housing 20 immediately. An air permeable heating means 40 is positioned transversely to the axis of the housing 20 inside the chamber 23. Air is drawn into the respirator by the inhalation of the user and is heated by radiation as it passes over or near the heating means 40. Although any number of heating methods can be employed by the device, the preferred embodiment contemplates a simple electrical resistance heating element 42 mounted on a rigid supporting screen 46, as shown in FIG. 3. Air drawn into the device is radially heated as it passes through the screen in close proximity to the heating element. The screen is fixed to the interior surface 27 of the housing 20 in such a way that the plane of the screen transects the chamber 23 and is perpendicular to its axis. Referring again to FIG. 2, a conducting means such as insulated copper wire 44 is attached to the heating element 42 at one end 43. Exiting the respirator through a small aperature 29 in the housing, the wire 44 eventually connects to the terminals of a remote power source, not shown, from which electrical energy is conveyed to the heating element. In the preferred embodiment, the power source is a battery which can be carried in a shirt or jacket pocket of the wearer.

An intake valve means 50 is situated transversely to the axis of the chamber 23 and effectively divides the chamber into two parts: The receiving chamber 55, open to the outside, and in which the heating element is positioned; and the internal chamber 56 which is contiguous with the cavity 38 existing between the mask and the face of the user. Envisioned in the embodiment of the respirator shown in FIG. 2 is an elementary diaphragm intake valve which is opened by suction created upon inhalation. Air is then drawn into the internal chamber 56, then into the mask cavity 38, and finally into the respiratory system of the user.

The construction of the respirator 10 and the disposition of the heating element 40 and the intake valve 50 represents a significant improvement over presently-existing devices. In masks and respirators presently available, the entire quantity of air inhaled in each breath is heated as it is being drawn in by suction. When the user is working strenuously or otherwise is forced to exert himself, his breathing becomes heavier and more rapid. As a result, the speed of the air flow past or through the heating means is increased, thereby reducing the amount of time such air is exposed to it. Consequently, the temperature of the inhaled air is significantly lower in such situations, and where the ambient air is extremely cold it may be insufficient to satisfy the user's needs.

Unlike devices of the prior art, the present invention is not totally dependent on the heating means to increase the air temperature as it is flowing by during inhalation. The receiving chamber 55 acts as a receiver for air which has already been warmed as it was drawn past the heating means 40 and the temperature of this air continues to rise while it remains confined. It is the air present in the receiving chamber 55 which first enters the intake valve 50 and is inhaled upon the user's next breath. The housing 20 can be constructed and the intake valve 50 can be situated so as to vary the size of the receiving chamber 55, in order to accommodate the requirements posed by various users and climates. It is easily seen that in a construction with the relative chamber sizes of the embodiment shown, the air contained in the receiving chamber 55 alone may satisfy the normal breathing needs of the user. Where rapid or heavy breathing is necessary, a large percentage of the air inhaled in each breath still originates from the receiving chamber 55. Accordingly, the user is not as dependent on the heating means to warm the air as it flows past upon inhalation and an adequate supply of heated air is assured.

Exhaled air leaves the respirator through an exhaust valve means 70, which in the preferred embodiment is also a diaphragm-type valve opened by the force of the exhalation. For best results, the exhaust valve 70 is positioned on the underside 25 of the housing 20 encompassing the internal chamber 56. Warm, exhaled air is usually laden with water vapor which easily condenses on cold surfaces. If the user is wearing goggles or eyeglasses, water vapor from rising exhaled air may condense, thereby clouding the lenses. By placing the exhaust valve 70 on the underside surface of the housing 20, the likelihood of this problem is greatly reduced.

Another embodiment 11 of the device is disclosed in FIG. 4. The housing 20 is constructed in such a manner that the cross-sectional area of the internal chamber 56 is larger than the cross-sectional area of the receiving chamber 55. Such a result can be achieved by constructing the respirator so that the radius of the housing about its axis is greater along the portion defining the internal chamber 56 than elsewhere, or as shown in FIG. 4, by constructing the device so that the thickness of the housing about the internal chamber 56 is less than it is about the receiving chamber 55. As a result of this feature, air is inhaled at a higher temperature due to the turbulence occurring in the air flow as it passes into a conduit of greater cross-sectional area. As is well known, a flow of air in such a situation will expand to fill the entire volume, thereby disrupting the smooth flow. The energy dissipated by the resulting turbulence serves to maintain the warm temperature of the air while it is being drawn into the user's respiratory system.

It will thus be seen that there is disclosed an improved frigid air respirator that can provide an assured supply of heated air to the user in environments containing extremely cold ambient air.

I claim:

1. A frigid air respirator comprising:

a cylindrical housing having two open ends and defining a cylindrical chamber;

a heating means mounted transversely inside said housing, inset a slight distance from one of said open ends and having openings permitting the flow of air therethrough;

an intake valve means disposed inside said housing so as to transect the cylindrical chamber into a receiving chamber and an internal chamber;

an exhaust valve means situated on said housing disposed so as to permit expulsion of air from said internal chamber;

a face mask conformed for positioning about the mouth and nose of the user attached circumferentially to said open end of said cylindrical housing opposite said heating means; and a means for securing the respirator about the head of the user.

2. A frigid air respirator according to claim 1 wherein the exhaust valve means is positioned on the underside of said housing.

* * * * *